US005382107A

United States Patent [19]

Nian

[11] Patent Number: 5,382,107

[45] Date of Patent: Jan. 17, 1995

[54] FOLDABLE TOOTHBRUSH

[76] Inventor: Jau-Jer Nian, No.2, Alley 71, Lane 42, Ting-Chin-Chung St., San-Min Dist., Kaohsiung City, Taiwan, Prov. of China

[21] Appl. No.: 180,552

[22] Filed: Jan. 12, 1994

[51] Int. Cl.[6] ..... A46B 11/02

[52] U.S. Cl. ..... 401/191; 15/185

[58] Field of Search ..... 401/191; 15/185; 132/311

[56] References Cited

U.S. PATENT DOCUMENTS

| | | | |
|---|---|---|---|
| 345,517 | 7/1886 | Lakin | 401/191 X |
| 1,006,857 | 10/1911 | Ljutica | 15/185 |
| 1,033,022 | 7/1912 | Kress | 15/185 |
| 1,153,801 | 9/1915 | Long | 15/185 |
| 1,659,628 | 2/1928 | Greenblatt | 401/191 X |
| 2,110,461 | 3/1938 | Chibnik | 15/185 |
| 2,850,753 | 9/1958 | Pelletier | 15/185 |

FOREIGN PATENT DOCUMENTS

| | | | |
|---|---|---|---|
| 1244454 | 9/1960 | France | 401/191 |
| 2623062 | 5/1989 | France | 401/191 |

*Primary Examiner*—Steven A. Bratlie

*Attorney, Agent, or Firm*—Curtis, Morris and Safford

[57] ABSTRACT

A toothbrush includes a handgrip portion and a head portion pivoted to the handgrip portion and movable between a folded position and a stretched position. The head portion includes a pair of lugs with a pair of first positioning notches and a pair of second positioning notches which are spaced angularly from the first positioning notches. The handgrip portion includes a pair of parallel plates. A spring-loaded slider provided between the parallel plates and has a projection that extends into the first notches of the head portion when the toothbrush is at the folded position and into the second notches when the toothbrush is at the stretched position. The slider is movable so as to release the projection from the first notches in order to cause the head portion to pivot relative to the handgrip portion to the stretched position due to the provision of a torsional spring which biases normally the head portion away from the handgrip portion.

4 Claims, 4 Drawing Sheets

FOLDABLE TOOTHBRUSH

BACKGROUND OF THE INVENTION

1. Field of the Invention

The invention relate to a toothbrush, more particularly to a foldable toothbrush which includes a head portion that can be pivoted relative to a handgrip portion to a stretched position when use.

2. Description of the Related Art

FIG. 1 shows a partially cross sectional view of a conventional foldable toothbrush 1 which includes an elongated handgrip portion 2, an elongated head portion 3 which has a predetermined width and a bristle unit 32 mounted securely at one end thereof, and a connector 4 which interconnects the head and handgrip portions 2, 3 pivotally so that one is movable relative to the other between a folded position, wherein the head portion 3 is folded relative to the handgrip portion 2 so as to lie on the latter, as illustrated by the dotted lines, and a stretched position, wherein the head portion 3 extends from the handgrip portion 2. The handgrip portion 2 has a rectangular toothpaste receiving chamber 25 formed therein and a bristle unit receiving recess 22 formed adjacent to the free end of the handgrip portion 2. The handgrip portion 2 has a through-hole 26 formed between the bristle unit receiving recess 22 and the toothpaste receiving chamber 25 so as to communicate the same. A rectangular disc 24 is provided slidingly in the chamber 25.

A threaded screw 23 extends into the receiving chamber 25 and extends threadedly into the rectangular disc 24. A knob 27 is connected to one end of the threaded screw 23 which extends out of the receiving chamber 25. When the knob 27 is rotated, the disc 24 moves linearly in the receiving chamber 25 so as to extrude an amount of toothpaste that is received in the chamber 25 into the bristle unit receiving recess 22.

Some of the drawbacks resulting from the use of the conventional foldable toothbrush are as follows:

(1) Since connector 4 itself cannot provide a biasing action to impel the head portion 3 into the stretched position, the user must pivot the head portion 3 away from the handgrip portion 2 so as to dispose the same at the stretched position. This can inconvenience the user of the conventional foldable toothbrush.

(2) The connector 4 has two round ends 21, 31 which extend respectively into two curved grooves of the head and handgrip portions 2, 3. Since the connector 4 is unable to provide firm and stable engagement between the head and handgrip portions 2 and 3, the head portion 3 shakes relative to the handgrip portion 2 when the conventional foldable toothbrush is in use.

(3) The handgrip portion 2 is relatively thick because the head portion 3 and the knob 27 of the threaded screw 23 are disposed on the same end of the handgrip portion 2. In addition, the head portion 3 lies on the handgrip portion 2 when at the folded position, thus increasing the overall thickness of the foldable toothbrush.

(4) The toothpaste receiving chamber 25 is not provided with an access means to permit refilling of toothpaste.

SUMMARY OF THE INVENTION

The main objective of the present invention is to provide a foldable toothbrush which can overcome the above mentioned drawbacks.

Accordingly, the foldable toothbrush of the present invention includes an elongated handgrip portion and an elongated head portion which is pivoted to the handgrip portion so as to move between a folded position and a stretched position. The head portion has a front end provided detachably with a bristle unit and a rear end which is provided with a spaced pair of oppositely facing first lugs. The first lugs have a pair of circular pivot holes that are coaxial with one another, a pair of first positioning peripheral notches that are aligned with one another, and a pair of second positioning peripheral notches that are aligned with one another and that are spaced angularly from the first notches. The handgrip portion has a first end, a second end and a pair of parallel plates which extend longitudinally from the first end. Each of the parallel plates has a longitudinal groove which corresponds with the longitudinal groove on the other one of the parallel plates. The parallel plates further have a spaced pair of oppositely facing second lugs which are respectively provided with a pivot hole that is coaxial with the pivot hole on the other one of the second lugs. Since the pivot holes of the first and second lugs are aligned with each other, a pin member which has a torsional spring sleeved thereon can extend therethrough so as to connect pivotally the head and handgrip portions. A slider is provided between the parallel plates and engages slidingly the longitudinal grooves of the same. The slider has a projection that extends towards the pin. A spring is provided between the slider and the first end of the handgrip portion so as to urge the slider to insert the projection into the first positioning peripheral notches of the first lugs when the toothbrush is at the folded position and into the second positioning peripheral notches of the first lugs when the toothbrush is at the stretched position. The projection of the slider engages the notches firmly and stably so that the head portion does not shake relative to the handgrip portion.

When the toothbrush is at the folded position, movement of the slider against biasing action of the spring enables the projection to disengage from the second positioning notches so that head portion pivots relative to the handgrip portion so as to be disposed in the stretched position.

In the preferred embodiment, the handgrip portion has a tubular wall body that interconnects the first and second ends thereof, and a partition wall disposed in the wall body and transverse to the axis of the same so as to divide the tubular wall body into a front chamber adjacent to the first end and a rear chamber adjacent to the second end. The partition wall has an access hole which communicates the chambers. The front chamber is provided with an opening formed through the wall body to receive the bristle unit when the toothbrush is at the folded position. Since the parallel plates are slender when compared to the tubular wall body, the head portion can be disposed on the parallel plates and is flush with the tubular wall body when the toothbrush is at the folded position. Thus the overall thickness of the toothbrush of the present invention is smaller than that of the conventional foldable toothbrush. The feature is achieved further due to the provision of the threaded shaft in the rear chamber via the second end of the handgrip portion. The rear chamber is further provided with a detachable cover lid so as to facilitate refilling of toothpaste into the same.

BRIEF DESCRIPTION OF THE DRAWINGS

Other features and advantages of the present invention will become more apparent in the following detailed description of the preferred embodiment with reference to the accompanying drawings, in which.

DETAILED DESCRIPTION OF THE PREFERRED EMBODIMENT

Figure 1:
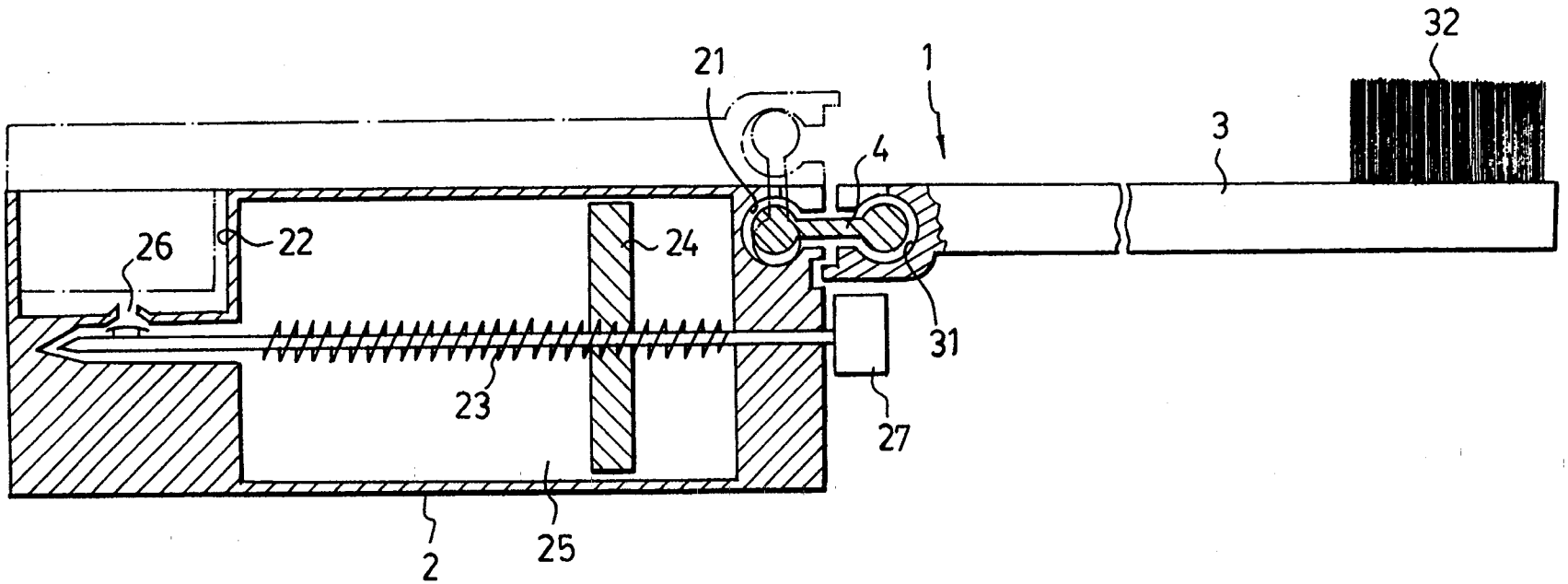
FIG. 1 (PRIOR ART)
FIG. 1 shows a partially cross sectional view of a conventional foldable toothbrush.
Figure 2:
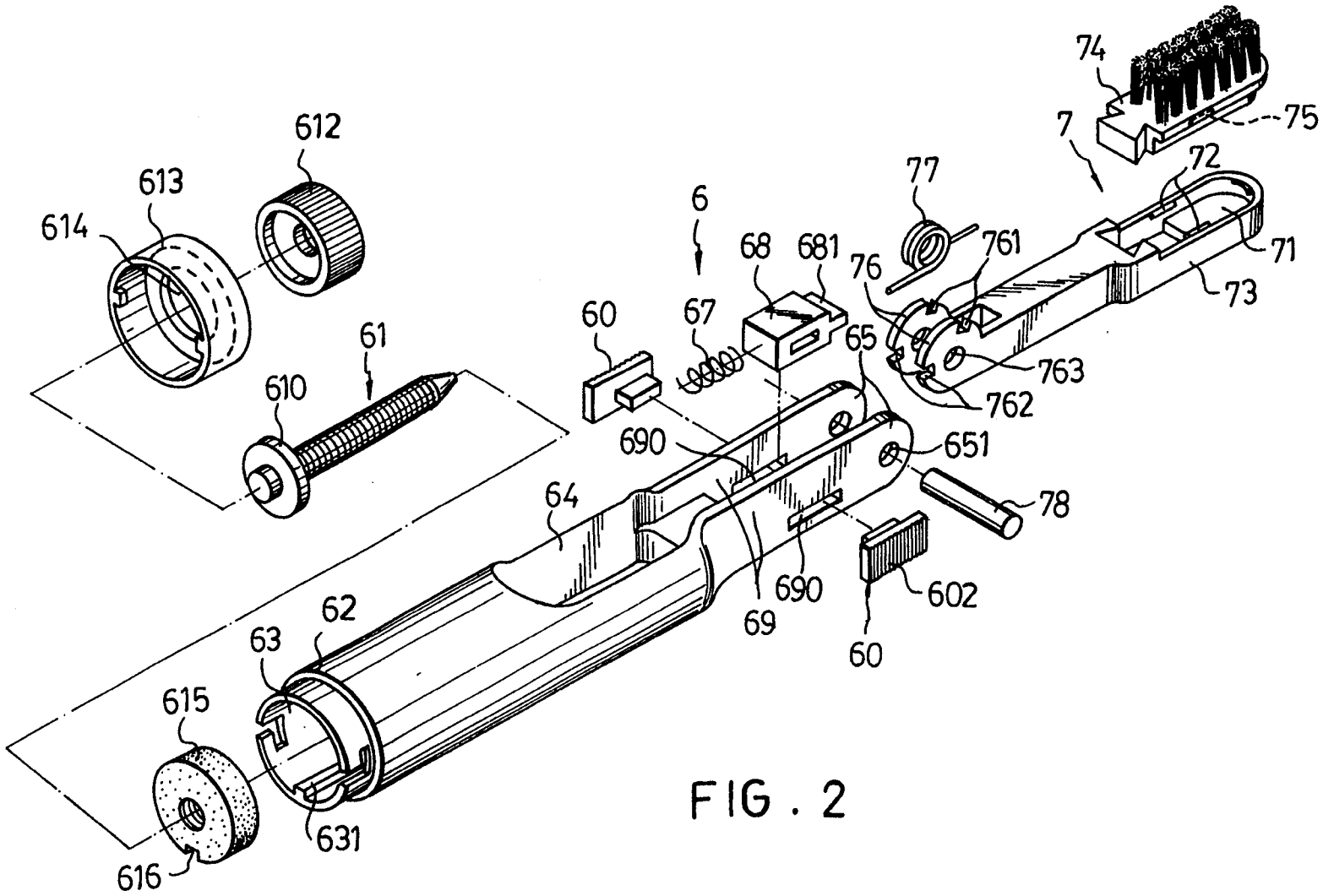
FIG. 2 shows an exploded view of a foldable toothbrush of the present invention.
Figure 4:
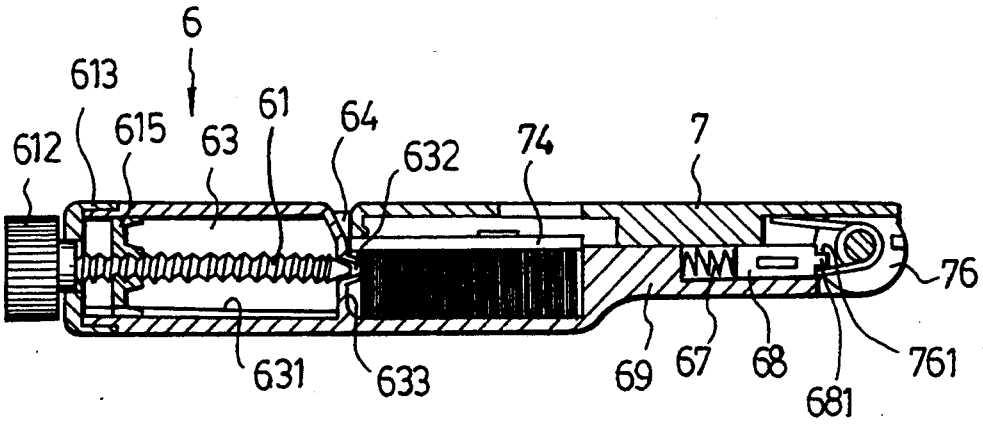
FIG. 4 is a cross sectional view of the toothbrush of the present invention when in a folded position.
Figure 5:
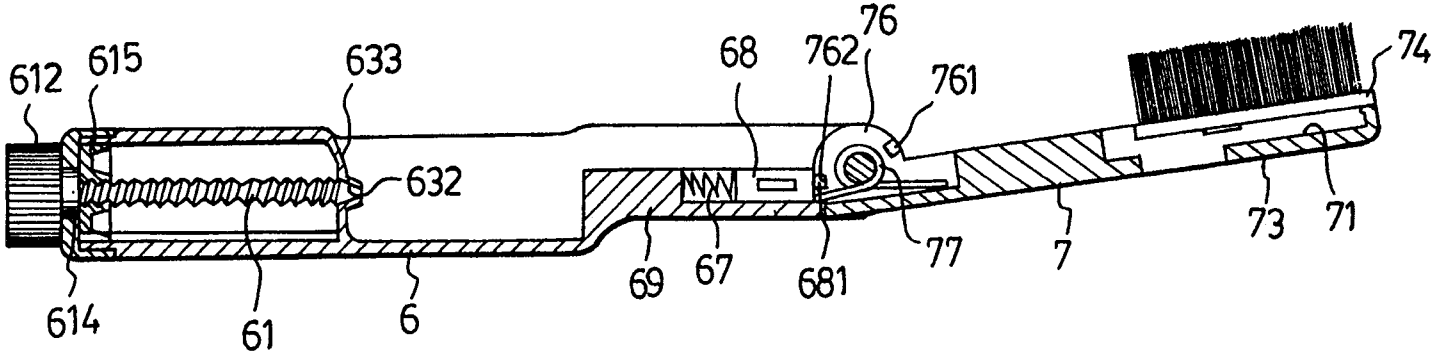
FIG. 5 shows a cross sectional view of the foldable toothbrush of the present invention when in a stretched position.

Referring to FIG. 2, an exploded view of a foldable toothbrush of the present invention is shown to comprise an elongated handgrip portion 6 and an elongated head portion 7 which is pivoted to the handgrip portion 6 so as to move between a folded position, as shown in FIG. 4, and a stretched position, as shown in FIG. 5.

Referring again to FIG. 2, the head portion 7 is substantially flat with a predetermined length and width and has a front end with a receiving groove 71 which is confined by a surrounding wall 73 that has a pair of opposed engaging slots 72, and a rear end which is provided with a spaced pair of oppositely first lugs 76. The first lugs 76 have a pair of circular pivot holes 763 that are coaxial with one another, a pair of first positioning peripheral notches 761 that are aligned with one another and a pair of second positioning peripheral notches 762 that are aligned with one another and are spaced angularly from the first pair of positioning peripheral notches 761.

A bristle unit includes a positioning plate 74 that has bundles of bristles projecting upwardly therefrom and two opposed engaging tabs 75 which engage the slots 2. The bristle unit is dovetailed in the receiving groove 71 of the head portion 7, so that the bristle unit may be held firmly therein while permitting removal of the same for replacement.

Figure 3:
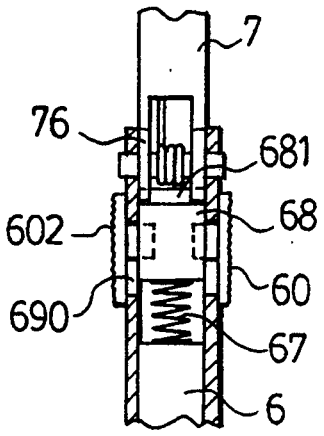
FIG. 3 is a partially cross sectional view illustrating the connection between the head and handgrip portions of the foldable toothbrush of the present invention.

The handgrip portion 6 has a tubular wall body that has a first end provided with a rectangular block 6, a second end 62 opposite to the first end, and a pair of parallel plates 69 which extend axially from the first end. Each of the parallel plates 69 has a longitudinal groove 690 which corresponds with the longitudinal groove 690 of the other one of the parallel plates 69. The parallel plates 69 further have a spaced pair of oppositely facing second lugs 65. Each of the second lugs 65 has a circular pivot hole 651 which is coaxial with the pivot holes 763 of the first lugs 76. A pin member 78 which has a torsional spring 77 sleeved thereon, passes through the pivot holes 763, 651 of the first and second lugs 76, 65 so as to connect the head portion 7 and the handgrip portion 6 pivotally. The two ends of the torsional spring 77 biases the head and handgrip portions 6, 7 to be in a stretched position, as best illustrated in FIG. 3.

A slider 68 is disposed between the parallel plates 69. A pair of engaging pieces 60 extend into the longitudinal grooves 690 of the parallel plates 69 and engage the slider 68, thereby enabling the slider 68 to move slidingly along the longitudinal grooves 69. A spring member 67 is provided between the block 66 and the slider 68, and urges the slider 68 forwardly. Since the slider 68 has a projection 681 which is aligned with the second positioning peripheral notches 762 of the first lugs 76 when the toothbrush is at the stretched position, the projection 681 can be inserted in the second notches 762 to retain the toothbrush at the stretched position, as shown in FIG. 5.

The head portion 7 can be pivoted relative to the handgrip portion 6 against biasing action of the torsional spring 77 so as to be disposed in the folded position, as shown in FIG. 4. Under such a condition, the first positioning peripheral notches 761 of the first lugs 76 are aligned with the projection 681, thereby permitting the latter to be inserted therein. Movement of the slider 68 against biasing action of the spring 67 can disengage the projection 681 from the first positioning notches 761, thereby allowing the head portion 7 to pivot automatically to the stretched position. The external surface of the engaging pieces 60 are provided with treads 602 to facilitate handling of the same. Because the projection 681 engages the positioning notches 761, 762 firmly and stably at the folded and stretched positions, the head portion 7 does not shake relative to the handgrip portion 6.

The tubular wall body of the handgrip portion 6 further has a partition wall 633 therein in a direction transverse to the axis of the same so as to divide the wall body into a front chamber 64 and a rear chamber 63. The front chamber 64 has an opening 64 formed adjacent to the front end of the wall body to receive the bristle unit at when the toothbrush is at the folded position. The partition wall 633 has an access hole 632 formed therethrough to communicate the front and rear chambers 63, 64. The rear chamber 63 further has a guiding rib 631 which extends axially therein. A circular disc 615 is provided slidingly in the rear chamber 63 and has a peripheral groove 616 which engages the guiding rib 631. A covering lid 613 with a central opening 614 is capped detachably to the second end 62 of the wall body 6. The covering lid 613 in the handgrip portion facilitates the refilling of toothpaste in the rear chamber 63. A threaded shaft 61 with a turning knob 610 extends into the rear chamber 63 via the covering lid 613 and engages threadedly the circular disc 615. The turning knob 610 of the threaded rod 61 extends out of the second end 62 of the handgrip portion 6. An externally threaded covering sheath 612 is attached to the turning knob 610 to facilitate handling of the same. When the threaded shaft 61 is rotated, the circular disc 615 moves linearly in the rear chamber 63 to extrude an amount of toothpaste which is received in the rear chamber 63 into the front chamber 64. The front and rear chambers 64, 63 respectively serve as bristle and toothpaste receiving chambers.

Referring again to FIG. 4, the parallel plates 69 are slender when compared to the wall body, thereby forming a space to receive the head portion 7 when the toothbrush is at the folded position. Under such a condition, the head portion 7 is flush with an external surface of the wall body. In addition, the provision of the threaded shaft 61 in the rear chamber 63 via the second end 62 of the handgrip portion 6 also permits a reduction in the thickness of the wall body. Thus, the overall size of the toothbrush is accordingly minimized.

While a preferred embodiment has been described and explained, it will be apparent that many changes and modifications can be made in the general construction and arrangement of the present invention without departing from the scope and spirit thereof. Therefore, it is desired that the present invention be not limited to the exact disclosure but only to the extent of the appended claims.

I claim:

1. A toothbrush comprising:

an elongated handgrip portion and an elongated head portion which is pivoted to said handgrip portion and movable between a folded position and a stretched position;

said elongated head portion having a front end provided with a bristle unit and a rear end provided with a spaced pair of oppositely facing first lugs, said pair of first lugs having a pair of circular pivot holes that are coaxial with one another, a pair of first positioning peripheral notches that are aligned with one another, a pair of second positioning peripheral notches that are aligned with one another and that are angularly spaced from said pair of first positioning peripheral notches;

said elongated handgrip portion having a first end, a second end and a pair of spaced parallel plates which extend longitudinally from said first end, each of said parallel plates having a longitudinal groove which corresponds with said longitudinal groove on the other one of said parallel plates, said parallel plates further having a spaced pair of oppositely facing second lugs which are respectively provided with a circular pivot hole that is coaxial with said pivot hole on the other one of said second lugs, said pivot holes of said second lugs being aligned with said circular pivot holes of said first lugs to permit passage of a pin with a torsional spring sleeved thereon, thereby connecting pivotally said head and handgrip portions; and a slider for retaining the toothbrush in said respective folded and stretched positions wherein said slider is provided between said parallel plates and engaging slidingly in longitudinal grooves, said slider having a projection extending longitudinally towards said pin, said slider being biased by a spring member provided between said first end of said handgrip portion and said slider to urge said slider to insert said projection into said first positioning peripheral notches of said first lugs when said toothbrush is at said folded position, and into said second positioning peripheral notches of said first lugs when said toothbrush is at said stretched position.

2. The toothbrush as defined in claim 1, wherein said handgrip portion has a tubular wall body interconnecting said first and second ends, and a partition wall disposed in said wall body and transverse to an axis of said wall body, said partition wall dividing said wall body into a front chamber adjacent to said first end and a rear chamber adjacent to said second end, said front chamber being provided with an opening to receive said bristle unit when said toothbrush is at said folded position, said partition wall having an access hole communicating said front and rear chambers.

3. The toothbrush as defined in claim 2, wherein said rear chamber has a guiding rib formed axially on an inner surface of said wall body and a circular disc provided therein, having an axial groove engaging slidingly said guiding rib, said rear chamber further having a covering lid connected detachably to said second end of said handgrip portion and a threaded shaft passing through said covering lid and extending into said rear chamber, said threaded shaft engaging threadedly said circular disc and being rotatable so as to move said circular disc linearly.

4. The toothbrush as defined in claim 2, wherein said parallel plates are slender in comparison to said wall body, said head portion being disposed on said parallel plates and being flush with an external surface of said tubular wall body when said toothbrush is at said folded position.

* * * * *